US009392380B2

(12) United States Patent
Sunohara

(10) Patent No.: US 9,392,380 B2
(45) Date of Patent: Jul. 12, 2016

(54) HEARING AID AND FEEDBACK CANCELLER

(71) Applicant: RION Co., Ltd., Tokyo (JP)

(72) Inventor: Masahiro Sunohara, Tokyo (JP)

(73) Assignee: RION CO., LTD., Tokyo (JP)

( * ) Notice: Subject to any disclaimer, the term of this patent is extended or adjusted under 35 U.S.C. 154(b) by 0 days.

(21) Appl. No.: 14/791,959

(22) Filed: Jul. 6, 2015

(65) Prior Publication Data

US 2016/0007126 A1 Jan. 7, 2016

(30) Foreign Application Priority Data

Jul. 7, 2014 (JP) ..... 2014-139837

(51) Int. Cl.
*H04R 25/00* (2006.01)

(52) U.S. Cl.
CPC ..... *H04R 25/453* (2013.01); *G10K 2210/3055* (2013.01); *H04R 2225/43* (2013.01); *H04R 2460/01* (2013.01)

(58) Field of Classification Search
CPC ..... H04R 25/453; H04R 225/43; H04R 2460/01; G10K 2210/3055
See application file for complete search history.

(56) References Cited

U.S. PATENT DOCUMENTS

2007/0223755 A1* 9/2007 Salvetti ..... H04M 9/082 381/318
2008/0095389 A1* 4/2008 Theverapperuma . H04R 25/453 381/318
2009/0196445 A1* 8/2009 Elmedyb ..... H04R 25/453 381/318
2011/0211715 A1* 9/2011 Pape ..... H04R 25/453 381/318
2011/0293124 A1 12/2011 Ma
2013/0259277 A1* 10/2013 Kojima ..... H04R 25/453 381/317
2014/0112508 A1 4/2014 Ma
2014/0146977 A1* 5/2014 Munk ..... H04R 3/02 381/71.11

FOREIGN PATENT DOCUMENTS

JP H06-130968 A 5/1994
JP 2002-526961 A 8/2002
JP 2011-254468 A 12/2011

* cited by examiner

*Primary Examiner* — Tuan D Nguyen
(74) *Attorney, Agent, or Firm* — Troutman Sanders LLP

(57) ABSTRACT

A hearing aid according to an embodiment of the present disclosure includes: a microphone configured to convert sound into an electric signal and output a first signal; a receiver configured to convert the third signal that is generated by performing predetermined hearing aid processing on a second signal, into sound; a first feedback removal unit having an adaptive filter configured to adaptively estimate a first transfer function of a sound feedback path from the receiver to the microphone; and a second feedback removal unit having a fixed filter configured to receive the third signal and use a fixed filter coefficient based on a second transfer function of a vibration feedback path from the receiver to the microphone. The second signal is generated by removing from the first signal, output signals from the adaptive filter and the fixed filter.

7 Claims, 3 Drawing Sheets

HEARING AID AND FEEDBACK CANCELLER

CROSS-REFERENCE TO RELATED APPLICATION

This application claims priority from Japanese Patent Application No. 2014-139837 filed with the Japan Patent Office on Jul. 7, 2014, the entire contents of which are hereby incorporated by reference.

BACKGROUND

1. Technical Field

The present disclosure relates to a hearing aid and a feedback canceller.

2. Related Art

A general hearing aid includes a microphone for collecting sound transferred from external space and a receiver for outputting sound to a user's ear canal. During usage of the hearing aid, sound output from the receiver may be fed back to the microphone to cause howling. To suppress such occurrence of howling, there is a known feedback canceller using an adaptive filter configured to adaptively estimate a feedback transfer function, as a device used for a hearing aid and feedback canceller including a structure capable of suppressing occurrence of howling (refer to JP-A-6-130968, for example). In general, an especially low-frequency band component is input into this kind of feedback canceller, the adaptive filter is likely to perform unstable operations. To solve this problem, JP-T-2002-526961 discloses a feedback canceller having a filter (high-pass filter or band-pass filter) for removing a low-frequency band component that is inserted into the stage preceding an adaptive filter. In addition, JP-A-2011-254468 discloses a feedback canceller having a fixed filter for modeling an unchanged portion of a feedback path that is inserted into the stage preceding an adaptive filter.

SUMMARY

A hearing aid according to an embodiment of the present disclosure includes: a microphone configured to convert sound into an electric signal and output a first signal; a hearing aid processing unit configured to perform predetermined hearing aid processing on a second signal to generate a third signal; a receiver configured to convert the third signal into sound; a first feedback removal unit having an input filter configured to attenuate a predetermined low-frequency band component included in the third signal, and an adaptive filter configured to receive an output signal from the input filter and adaptively estimate a first transfer function of a sound feedback path from the receiver to the microphone; and a second feedback removal unit having a fixed filter configured to receive the third signal and use a fixed filter coefficient based on a second transfer function of a vibration feedback path from the receiver to the microphone. The first feedback removal unit and the second feedback removal unit are connected in parallel to each other. The second signal is generated by removing from the first signal an output signal from the adaptive filter included in the first feedback removal unit and an output signal from the fixed filter included in the second feedback removal unit.

DETAILED DESCRIPTION

Figure 1:
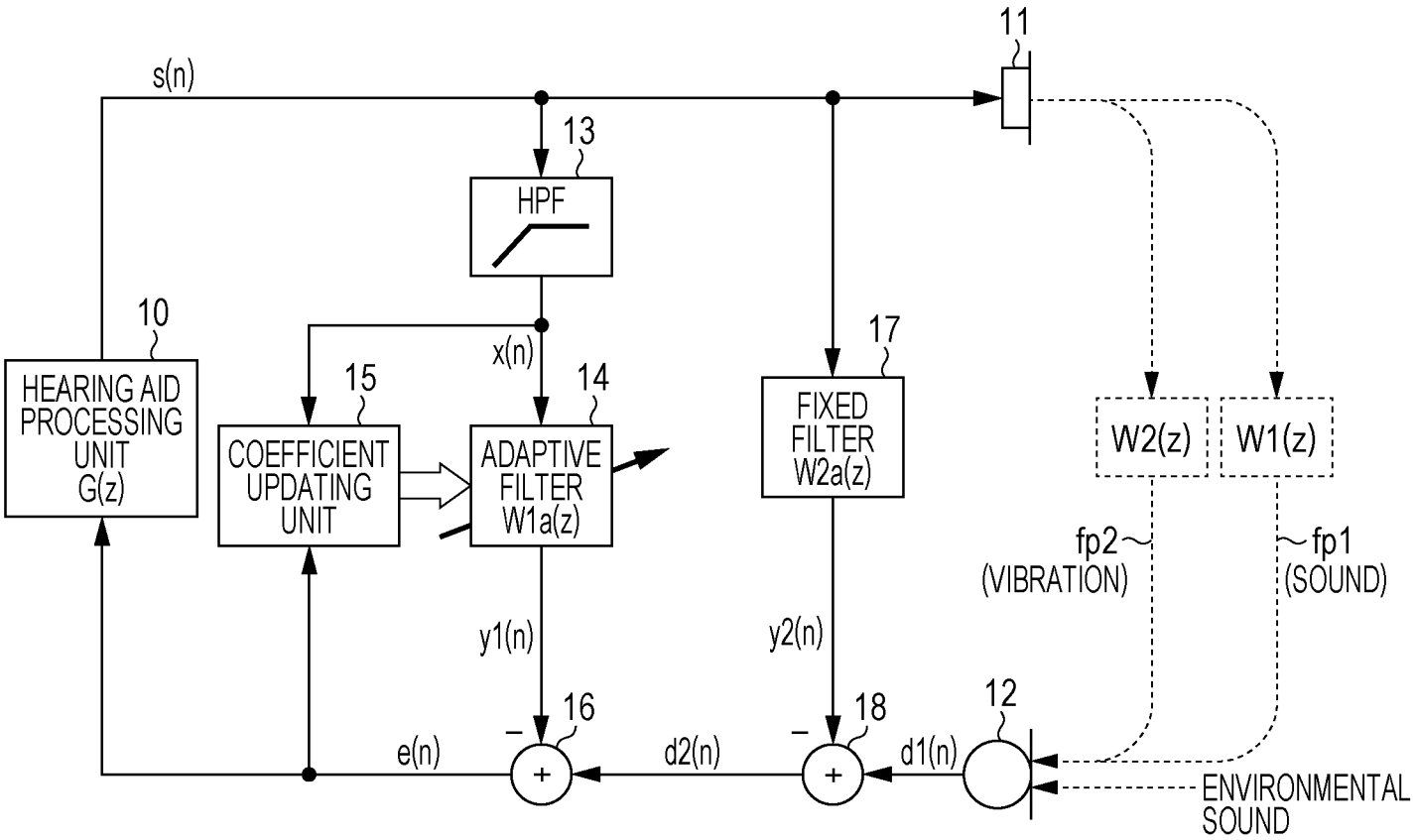
FIG. 1 is a block diagram illustrating a specific structure example related to digital signal processing in a hearing aid of an embodiment.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In a general hearing aid, feedback is caused because sound that is output from a receiver set in a user's ear canal is input into an external microphone via air. In addition, feedback is also caused because vibration of the receiver is transferred to the microphone. When the gain of the hearing aid is low, the feedback caused by vibration poses no problem. However, when the gain of the hearing aid becomes high, the feedback caused by vibration may result in ringing and howling. In a wide range of frequency components included in the vibration of the receiver, the feedback caused by vibration tends to be larger as compared to the feedback caused by sound in an especially low-frequency band. Meanwhile, when an especially low-frequency band component is input into the adaptive filter, failures of the adaptive operation of the filter may be caused. Specifically, when a low-frequency input signal close to a sine wave is input into the adaptive filter, a so-called entrainment occurs. This results in a known phenomenon in which the input signal is distorted. For example, when a low-frequency band component as a cause of an entrainment is removed by a filter by the technique disclosed in JP-T-2002-526961, it is not possible to suppress low-frequency howling. As a result, it is difficult to suppress feedback of a low-frequency component by the adaptive filter. In addition, the technique disclosed in JP-A-2011-254468 does not take a low-frequency band into account and therefore cannot suppress an entrainment. That is, according to the above conventional structures, it is difficult to suppress an entrainment without causing any trouble in feedback suppression performance of the feedback canceller. Consequently, there is a problem that feedback canceller operating favorably in a wide frequency band cannot be realized.

A hearing aid and a feedback canceller according to an embodiment of the present disclosure are provided to solve the problems. An object of the present disclosure is to provide a hearing aid and the like that can stably suppress feedback of sound and vibration to effectively suppress failures resulting from occurrence of an entrainment.

In order to solve the above described problems, a hearing aid according to an embodiment of the present disclosure includes: a microphone (12) configured to convert sound into an electric signal and output a first signal (d1($n$)); a hearing aid processing unit (10) configured to perform predetermined hearing aid processing on a second signal (e(n)) generated based on the first signal to generate a third signal (s(n)); a receiver (11) configured to convert the third signal into sound; a first feedback removal unit (13, 14, 15, 16) having an input filter (13) configured to attenuate a predetermined low-frequency band component included in the third signal, and an adaptive filter (14) configured to receive an output signal from the input filter and adaptively estimate a first transfer function (W1($z$)) of a sound feedback path from the receiver to the microphone; and a second feedback removal unit (17, 18)

having a fixed filter (17) configured to receive the third signal and use a fixed filter coefficient based on a second transfer function (W2($z$)) of a vibration feedback path from the receiver to the microphone. The first feedback removal unit and the second feedback removal unit are connected in parallel to each other. The second signal is generated by removing from the first signal an output signal from the adaptive filter included in the first feedback removal unit and an output signal from the fixed filter included in the second feedback removal unit.

In the hearing aid according to the embodiment of the present disclosure, in relation to the feedback paths of sound and vibration existing between the receiver and the microphone, the first feedback removal unit including the adaptive filter estimating the first transfer function of the sound feedback path and the second feedback removal unit including the fixed filter based on the second transfer function of the vibration feedback path are arranged in parallel to each other. In addition, the input filter is inserted into the input side of the adaptive filter to attenuate a predetermined low-frequency band component. This suppresses occurrence of an entrainment that is likely to occur when a low-frequency band signal is input into the adaptive filter. The fixed filter is used in the second feedback removal unit with no occurrence of an entrainment. As described above, by employing the structure of the hearing aid according to the embodiment of the present disclosure, favorable feedback suppression performance in a wide frequency band can be secured while suppressing an entrainment.

The hearing aid according to the embodiment of the present disclosure may be structured such that the second feedback removal unit includes a first subtraction unit configured to subtract an output signal from the fixed filter from the first signal and output a fourth signal, and the first feedback removal unit includes a second subtraction unit configured to subtract an output signal from the adaptive filter from the fourth signal and output the second signal. Accordingly, after the first signal output from the microphone has passed through the first and second subtraction units, feedback components output from the first and second feedback removal units respectively are removed from the first signal. This allows generation of the second signal.

The hearing aid according to the embodiment of the present disclosure may be configured to be switchable between a first operation mode in which to operate both of the first and second feedback removal units and a second operation mode in which to operate only the second feedback removal unit. For example, a switch for switching between the first and second operation modes may be provided. Accordingly, the first operation mode can be set when it is necessary to suppress howling of the hearing aid mainly resulting from sound feedback, and the second operation mode can be set when the howling does not occur.

In order to solve the above described problems, a hearing aid according to another embodiment of the present disclosure may be configured to include: a microphone configured to convert sound into an electric signal and output a first signal; a hearing aid processing unit configured to perform predetermined hearing aid processing on a second signal generated based on the first signal to generate a third signal; a receiver configured to convert the third signal into sound; a telephone coil configured to convert a magnetic signal into an electric signal and output a fifth signal; a first feedback removal unit having an input filter configured to attenuate a predetermined low-frequency band component included in the third signal, and an adaptive filter configured to receive an output signal from the input filter and adaptively estimate a first transfer function of a sound feedback path from the receiver to the microphone; a second feedback removal unit having a fixed filter configured to receive the third signal and use a fixed filter coefficient based on a second transfer function of a vibration feedback path from the receiver to the microphone; and a third feedback removal unit having a fixed filter configured to receive the third signal and use a fixed filter coefficient based on a third transfer function of a magnetic field feedback path from the receiver to the telephone coil. The second signal is generated by removing an output signal from the first feedback removal unit, an output signal from the second feedback removal unit, and an output signal from the third feedback removal unit, based on the first signal and the fifth signal. Accordingly, even when the magnetic field feedback path from the receiver to the telephone coil exists as well as the sound and vibration feedback paths, magnetic field feedback is allowed to be suppressed reliably by the same method.

In order to solve the above described problems, a feedback canceller according to an embodiment of the present disclosure is configured to include: a first conversion device configured to convert sound into an electric signal and output a first signal; a signal processing unit configured to perform predetermined hearing aid processing on a second signal generated based on the first signal to generate a third signal; a second conversion device configured to convert the third signal into sound; a first feedback removal unit having an input filter configured to attenuate a predetermined low-frequency band component included in the third signal, and an adaptive filter configured to receive an output signal from the input filter and adaptively estimate a first transfer function of a sound feedback path from the receiver to the microphone; and a second feedback removal unit having a fixed filter configured to receive the third signal and use a fixed filter coefficient based on a second transfer function of a vibration feedback path from the receiver to the microphone. The first feedback removal unit and the second feedback removal unit are connected in parallel to each other. The second signal is generated by removing, from the first signal, an output signal from the adaptive filter included in the first feedback removal unit, and an output signal from the fixed filter included in the second feedback removal unit. The feedback canceller according to the embodiment of the present disclosure is not limited to the above described hearing aid but can be incorporated into various apparatus. Even when being incorporated into any other apparatus, the feedback canceller can provide the same working effects as those in the hearing aid described above.

As described above, in the feedback canceller according to the embodiment of the present disclosure, the first feedback removal unit including the input filter and the adaptive filter and the second feedback removal unit including the fixed filter are arranged in parallel to each other. Accordingly, by blocking input of a low-frequency band component into the adaptive filter, occurrence of an entrainment can be suppressed. The fixed filter can remove a low-frequency band feedback component including a vibration system. Accordingly, favorable feedback suppression performance of the hearing aid or the like in a wide frequency band can be secured while suppressing failures resulting from an entrainment. This realizes an apparatus such as a hearing aid comfortable for a user.

Embodiment of the present disclosure will be described with reference to the accompanying drawings. In particular, an example of embodiment of the present disclosure applied to a hearing aid including a feedback canceller will be described.

FIG. 1 is a block diagram illustrating a specific structure example related to digital signal processing in a hearing aid of an embodiment. The structure example of FIG. 1 includes a hearing aid processing unit 10, a receiver 11, a microphone 12, a high-pass filter 13, an adaptive filter 14, a coefficient updating unit 15, a subtraction unit 16, a fixed filter 17, and a subtraction unit 18. All of these constituent elements other than the receiver 11 and the microphone 12, as an example, can be realized through signal processing by a DSP (digital signal processor) capable of digital signal processing. Each of the constituent elements illustrated in FIG. 1 operates with a power source supplied from a battery (not illustrated) set in the hearing aid. The entire operation of the hearing aid is controlled by a control unit (not illustrated). Although not illustrated in FIG. 1, a DA converter is provided at an input side of the receiver 11 to convert a digital signal into an analog signal, and an AD converter is provided at an output side of the microphone 12 to convert an analog signal into a digital signal. Examples of the hearing aid illustrated in FIG. 1 include various types of hearing aids including an in-the-ear type, a behind-the-ear type, and a body-worn type.

In the foregoing structure, the hearing aid processing unit 10 performs predetermined hearing aid processing that is adapted to each user and set respectively, on an error signal e(n) output from the subtraction unit 16, and outputs a signal s(n) after hearing aid processing. Examples of the applicable hearing aid processing performed by the hearing aid processing unit 10 include various types of processing such as addition of a predetermined gain to the input error signal e(n), multi-band compression, noise reduction, tone control, and output limit processing.

The receiver 11 is set in the user's ear canal, for example. The receiver 11 converts the foregoing signal s(n) output from the hearing aid processing unit 10 into sound and outputs the same to the space in the ear canal. The receiver 11 may be an electromagnetic receiver, for example. The microphone 12 collects sound transferred from the external space of the hearing aid and converts the same into an electric signal, and outputs the same as a desired signal d1($n$). The microphone 12 may be an MEMS (micro electro mechanical system) or a condenser microphone.

In the hearing aid illustrated in FIG. 1, it is preferable that only external environmental sound is input into the microphone 12. In actuality, however, the sound output from the receiver 11 recirculates from the ear canal into the microphone 12 through the external space. This makes feedback sound. For a sound feedback path fp1 at that time, a transfer function from the input of the receiver 11 to the output of the microphone 12 is represented as a transfer function W1($z$). Meanwhile, besides sound, vibration of the receiver 11 is also transferred from the receiver 11 to the microphone 12. Accordingly, there is a feedback component resulting from the vibration of the receiver 11 transferred to the microphone 12. For a vibration feedback path fp2, a transfer function from the input of the receiver 11 to the output of the microphone 12 is represented as a transfer function W2($z$). In this embodiment, feedback suppression is conducted with consideration given into both the transfer function W1($z$) based on sound feedback and the transfer function W2($z$) based on vibration feedback. Details of the feedback suppression will be described later.

To determine the actual transfer functions W1($z$) and W2($z$) of sound and vibration, it is considered that the transfer function of the receiver 11 and the transfer function of the microphone 12 intervene in the respective feedback paths fp1 and fp2. In this embodiment, however, the respective transfer functions of the receiver 11 and the microphone 12 will not be clearly specified for the convenience of description.

The high-pass filter 13 (the input filter according to the embodiment of the present disclosure) receives the signal s(n) after hearing aid processing and removes a predetermined low-frequency band component from the signal s(n) to generate an input signal x(n) for the adaptive filter 14. The role of the high-pass filter 13 is to remove a low-frequency component susceptible to the influence of an entrainment described later to input into the adaptive filter 14 a high-frequency component insusceptible to the influence of an entrainment. For example, a cutoff frequency of the high-pass filter 13 is set at about 1 kHz.

The adaptive filter 14 adaptively estimates a transfer function W1$a$($z$) obtained by estimating the transfer function W1($z$) of the sound feedback path fp1 described above with the use of a filter coefficient calculated by the coefficient updating unit 15 for the input signal x(n) output from the high-pass filter 13. Accordingly, an output signal y1($n$) is generated. The transfer function W1($z$) of the feedback path fp1 changes depending on the structure of the hearing aid, the behavior of the user, surrounding environments, and the like. To follow the changes, the coefficient updating unit 15 updates the coefficient of the adaptive filter 14. The adaptive filter 14 may be an FIR (finite impulse response) filter having a predetermined number of taps (e.g., 32 taps), for example. The coefficient updating unit 15 also calculates sequentially filter coefficients to be supplied to the adaptive filter 14 based on the input signal x(n) and the error signal e(n). The coefficient updating unit 15 may employ various adaptive algorithms such as LMS (least mean square) algorithm, for example.

The fixed filter 17 receives the signal s(n) after hearing aid processing, and uses a fixed filter coefficient corresponding to a transfer function W2$a$($z$) obtained by estimating the transfer function W2($z$) of the vibration feedback path fp2 described above to generate an output signal y2($n$). For example, filter data processing by the fixed filter 17 having filter coefficients w2$a$($k$) (k denotes an integer of 0 to M−1) can be expressed by convolution operation in the following formula (1):

$$y2(n) = \sum_{k=0}^{M-1} w2_a(k) \times (n-k) \tag{1}$$

The subtraction unit 18 subtracts the output signal y2($n$) generated by the fixed filter 17, from the desired signal d1($n$) output from the microphone 12, and outputs the same as a desired signal d2($n$). The subtraction unit 16 at the subsequent stage subtracts the output signal y1($n$) generated by the adaptive filter 14, from the desired signal d2($n$) output from the subtraction unit 18 at the preceding stage, and outputs the same as the foregoing error signal e(n). The data processing by the subtraction units 18 and 16 can be expressed by the following formulas (2) and (3) respectively:

$$d2(n)=d1(n)-y2(n) \tag{2}$$

$$e(n)=d2(n)-y1(n)=d1(n)-y1(n)-y2(n) \tag{3}$$

As illustrated in FIG. 1, the microphone 12, the subtraction units 16 and 18, the hearing aid processing unit 10, and the receiver 11 constitute a loop via the feedback paths fp1 and fp2. Accordingly, if a certain vibration condition is met, howling occurs. In this embodiment, a portion composed of the high-pass filter 13, the adaptive filter 14, the coefficient updating unit 15, and the subtraction unit 16 functions as a first feedback removal unit (and a feedback removal unit) according to the embodiment of the present disclosure. A portion composed of the fixed filter 17 and the subtraction unit 18 functions as a second feedback removal unit (and a feedback removal unit) according to the embodiment of the present disclosure. The first feedback removal unit and the second feedback removal unit are connected in parallel to each other. These removal units are also connected in parallel to the hearing aid processing unit 10. The first feedback removal unit mainly plays the role of removing a sound feedback component via the feedback path fp1. The second feedback removal unit mainly plays the role of removing a vibration feedback component via the feedback path fp2.

Referring to FIG. 1, the positions of the first feedback removal unit and the second feedback removal unit may be exchanged. Specifically, even when the first feedback removal unit is arranged at the next stage of the microphone 12 and the second feedback removal unit is arranged at the subsequent stage thereof, the result represented by the formula (3) can be obtained. In either case, the operation of the hearing aid is not different.

To determine the filter coefficient based on the transfer function W2*a*(*z*), the fixed filter 17 preliminarily estimates the transfer function W2(*z*) of the feedback path fp2. The microphone 12 generally cannot discriminate between input of sound and input of vibration. Accordingly, the sound hole of the receiver 11 is covered with a coupler or the like to form a condition where no sound leakage occurs. In such a manner, the transfer function W2(*z*) can be estimated by measuring characteristics of input/output from the receiver 11 to the microphone 12.

Figure 2:
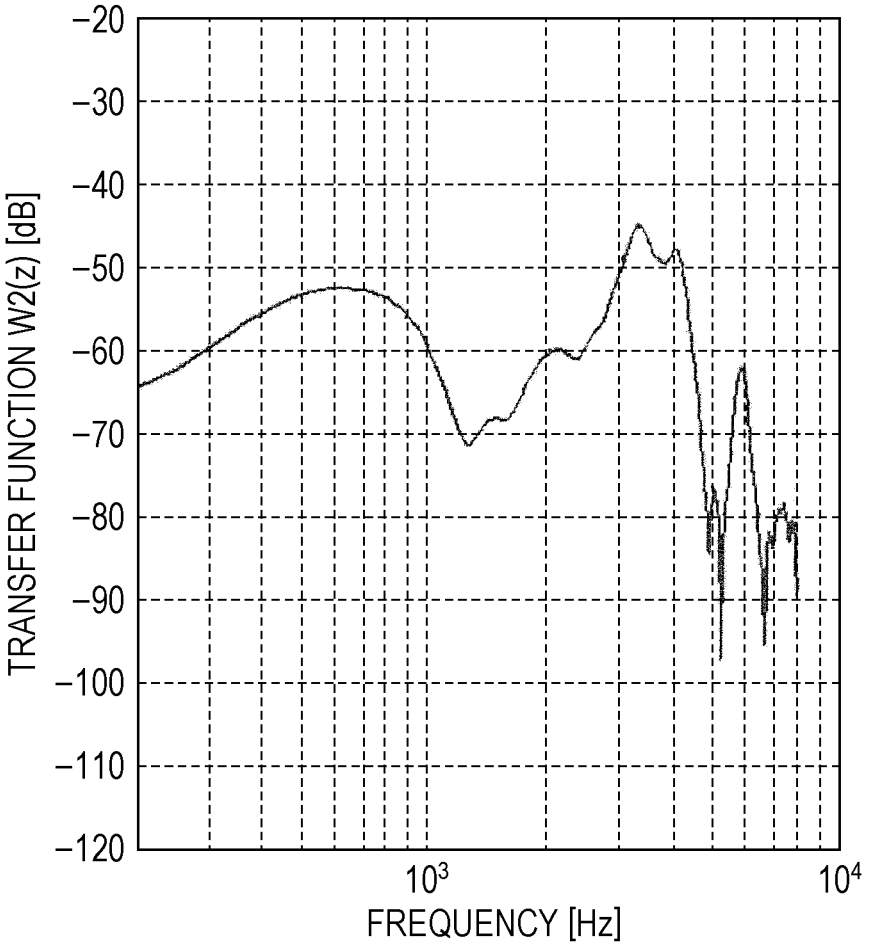
FIG. 2 is a chart illustrating an example of frequency characteristics of a transfer function W2($z$) of a feedback path fp2 in the hearing aid of the embodiment.

FIG. 2 is a chart illustrating an example of frequency characteristics of the transfer function W2(*z*) measured as described above. Specifically, a coupler of 2 $cm^3$ is hermetically set to the receiver 11 to prevent sound leakage. Then, pure sound or a sine wave signal of 0.2 to 8 kHz is input into the receiver 11. In FIG. 2, the level of output (dB) from the microphone 12 at that time is graphed in a frequency region. As illustrated in FIG. 2, the transfer function W2(*z*) by vibration has a relatively wide frequency band. The transfer function W2(*z*) has peaks in a low-frequency band and a high-frequency band. Based on the results illustrated in FIG. 2, the transfer function W2*a*(*z*) of the fixed filter 17 can be determined. This allows the fixed filter coefficient to be calculated. However, FIG. 2 represents a mere example and, in actuality, various transfer functions W2(*z*) are assumed depending on the form of the hearing aid and operation environment.

As described above, according to the structure of this embodiment, the first feedback removal unit including the adaptive filter 14 and the second feedback removal unit including the fixed filter 17 are arranged in parallel to each other. A feedback component can be removed by both of the feedback removal units. In the case where only the first feedback removal unit is used without the fixed filter 17, it is necessary to remove a low-frequency feedback band component as well by the adaptive filter 14. Therefore, the low-frequency band is not attenuated by the high-pass filter 13. This may result in occurrence of an entrainment. Specifically, an entrainment is likely to occur in the situation where the input signal x(n) into the adaptive filter 14 is approximate to a low-frequency sine wave. At that time, the function of feedback removal is hindered. In this case, when the adaptive speed of the adaptive filter 14 is decreased, the influence of the entrainment can be suppressed. However, decreasing the gain makes it impossible to secure a sufficient level of sound pressure of the receiver 11. In addition, when the adaptive speed of the adaptive filter 14 is decreased, it takes more time for the transfer function W1*a* to converge. Therefore, there arises a problem in either case.

In contrast, the hearing aid according to this embodiment is configured such that a low-frequency band feedback component including a vibration system is removed by the second feedback removal unit. This hearing aid is also configured such that the high-pass filter 13 inserted into the input side of the first feedback removal unit prevents a low-frequency band component from being input into the adaptive filter 14. The second feedback removal unit has a fixed filter coefficient of the fixed filter 17. Accordingly, no entrainment occurs. Therefore, even when a low-frequency band feedback component including a vibration system is input, occurrence of an entrainment can be suppressed effectively. The feedback caused by vibration is less prone to be changed by external factors, unlike the feedback caused by sound. Accordingly, the feedback of vibration can be coped with the filter with a fixed coefficient. In this case, even when a high gain is added to the signal s(n) and the adaptive speed of the adaptive filter 14 is set to a high speed, howling of the hearing aid can be reliably suppressed using both of the adaptive filter 14 and the fixed filter 17. In general, a small-sized hearing aid is more largely influenced by howling. However, the structure of the hearing aid according to this embodiment enhances howling suppression performance. Accordingly, this embodiment is also suited for small-sized hearing aids.

Figure 3:
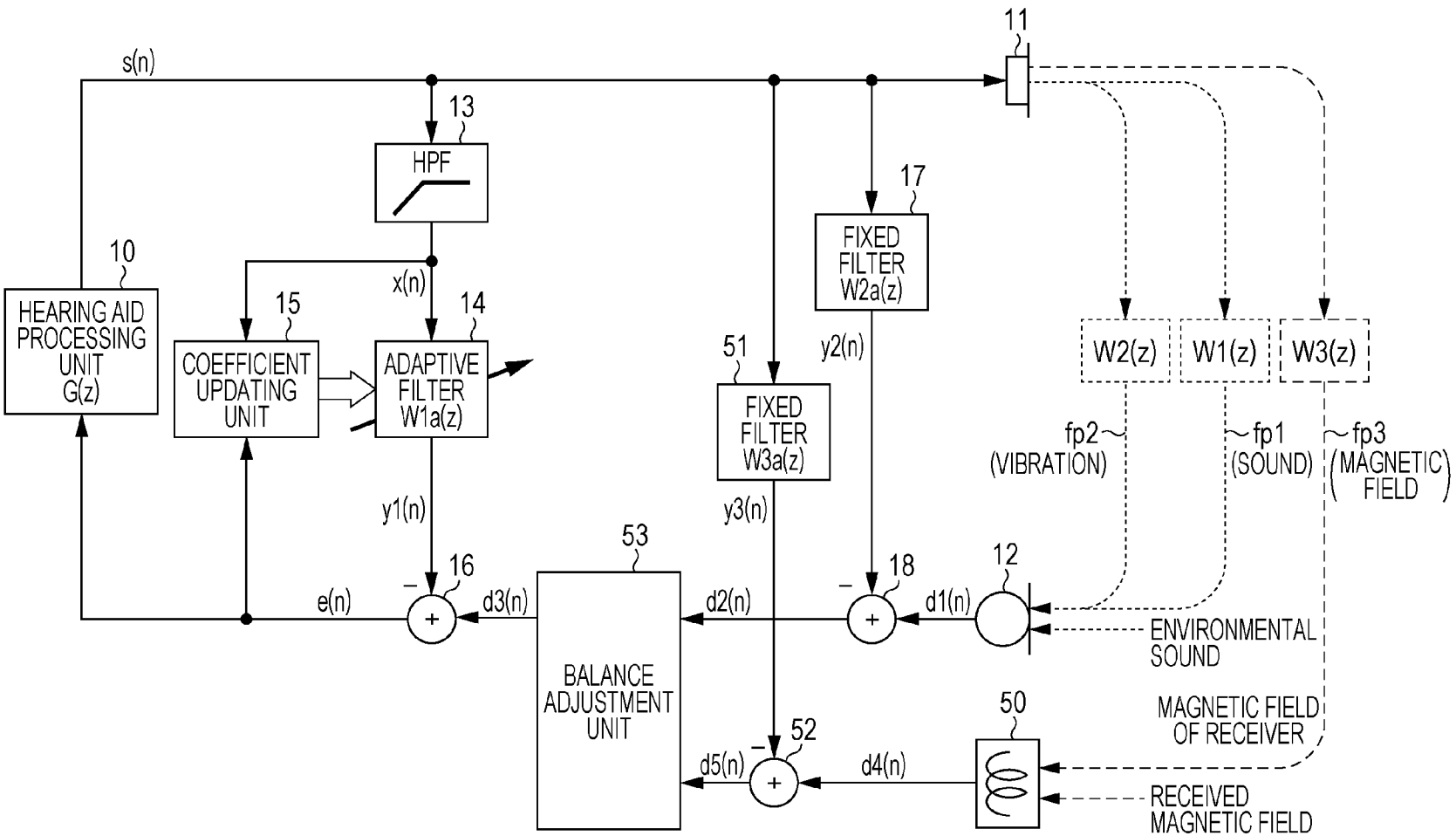
FIG. 3 is a block diagram illustrating a modification example of the hearing aid of the embodiment.

The structure of the hearing aid according to this embodiment is not limited to the structure example illustrated in FIG. 1. This hearing aid has various modification examples. FIG. 3 illustrates a modification example of the hearing aid illustrated in FIG. 1. The feature of the modification example in FIG. 3 is in that, in addition to the microphone 12 illustrated in FIG. 1, a telephone coil 50 is provided as a magnetic induction loop for receiving a magnetic field (magnetism) transmitted from an external device. The telephone coil 50 converts a received magnetic signal into an electric signal and outputs the same as a desired signal d4(*n*). At that time, together with the received magnetic field, a magnetic field generated by the receiver 11 is input into the telephone coil 50. That is, in addition to the feedback paths fp1 and fp2 illustrated in FIG. 1, there exists a magnetic field feedback path fp3. A transfer function from the input of the receiver 11 to the output of the telephone coil 50 along the feedback path fp3 is represented as a transfer function W3(*z*). As illustrated in FIG. 3, as a structure for operation of the telephone coil 50 and suppression of feedback from the operation, a fixed filter 51, a subtraction unit 52, and a balance adjustment unit 53 are provided.

A feedback removal unit composed of the fixed filter 51 and the subtraction unit 52 (a third feedback removal unit of the hearing aid according to the embodiment of the present disclosure) is arranged at the output side of the telephone coil 50. The fixed filter 51 receives a signal s(n) and generates an output signal y3(*n*) using a fixed filter coefficient corresponding to a transfer function W3*a*(*z*) obtained by estimating the transfer function W3(*z*) of the magnetic field feedback path fp3. The subtraction unit 52 subtracts the output signal y3(*n*) generated by the fixed filter 51, from the desired signal d4(*n*), and outputs the resultant as a signal d5(*n*). The transfer function W3*a*(*z*) of the fixed filter 51 can be determined in the same manner as the transfer function W2*a*(*z*) of the fixed filter 17 based on feedback of vibration. The balance adjustment unit 53 receives a signal d2(*n*) through the microphone 12 and the subtraction unit 18 and a signal d5(*n*) through the telephone coil 50 and the subtraction unit 52. The balance adjustment unit 53 outputs a desired signal d3(*n*) generated by mixing the two signals while adjusting the balance of the levels of the two signals. Subsequent operations are the same as those illustrated in FIG. 1 and thus descriptions thereof will be omitted.

According to the foregoing modification example, the transfer function W3($z$) of magnetic field feedback is stable with small fluctuations. Accordingly, employing the structure illustrated in FIG. 3 suppresses effectively a magnetic field feedback component. Referring to FIG. 3, the microphone 12 and the telephone coil 50 may be arranged so as to be directly connected at their respective output sides to the balance adjustment unit 53 via an amplifier. In this case, the second feedback removal unit composed of the fixed filter 17 and the subtraction unit 18 and the third feedback removal unit composed of the fixed filter 51 and the subtraction unit 52 are both arranged at the output side of the balance adjustment unit 53 in parallel to each other, or in such a manner that the fixed filters are united and also the subtraction units are united.

Another modification example may be employed in which the first feedback removal unit in this embodiment can be switched between start of operation and end of operation. Specifically, as operation modes for the hearing aid, first and second modes are set selectively. When the first operation mode is set, both of the first and second feedback removal units operate. When the second operation mode is set, control is performed such that the second feedback removal unit operates but the first feedback removal unit stops operation.

In this modification example, the first and second operation modes may be configured to be switched by the user operating an external switch provided on the hearing aid. In addition, the first and second operation modes may be configured such that a control unit (not illustrated) determines operational conditions to automatically switch between these operation modes. For example, it is considered that the second operation mode is to be set in a situation where howling can be suppressed without having to operate the adaptive filter 14 such as when the gain of the hearing aid is set to be low. In this case, the adaptive filter 14 is stopped and occurrence of an entrainment can be reliably suppressed. Meanwhile, the fixed filter 17 does not cause a failure such as an entrainment. Accordingly, it is desired that the fixed filter 17 is constantly in operational state.

Each of the foregoing embodiments discloses a case where the feedback canceller according to the embodiment of the present disclosure is applied to a hearing aid. However, the feedback canceller is also applicable to various apparatus other than the hearing aid. Specifically, by providing the structure illustrated in FIG. 1, a feedback canceller capable of realizing the functions of the feedback canceller in the embodiment of the present disclosure can be configured. The embodiment of the present disclosure can be applied to single use of the feedback canceller or incorporation of the same into another apparatus. In the feedback canceller, the hearing aid processing unit 10 (refer to FIG. 1) can be replaced by another signal processing unit with various functions. Various options are provided for the structure, settings for other operational conditions, and the like.

As in the foregoing, the contents of the embodiments of the present disclosure are specifically described according to the embodiments. However, the embodiments of the present disclosure are not limited to the foregoing embodiments. The embodiments of the present disclosure can be modified in various manners without deviating from the gist of this disclosure. For example, the high-pass filter 13 (refer to FIG. 1) as the input filter of the hearing aid according to the embodiment of the present disclosure may be replaced with an input filter such as a band-pass filter as an example, provided that it can remove a predetermined low-frequency band component. In addition, the specific structure and the control method for the hearing aid illustrated in FIG. 1 are not limited to the contents of this embodiment. As a matter of course, various structures and control methods can be employed other than the structure and control method described above.

The hearing aid according to the embodiment of the present disclosure may be any one of the following first to fifth hearing aids:

The first hearing aid includes: a microphone configured to convert sound into an electric signal and output a first signal; a hearing aid processing unit configured to perform predetermined hearing aid processing on a second signal generated based on the first signal to generate a third signal; a receiver configured to convert the third signal into sound; a first feedback removal unit having an input filter configured to attenuate a predetermined low-frequency band component from the third signal, and an adaptive filter configured to input an output signal from the input filter and adaptively estimate a first transfer function of a sound feedback path from the receiver to the microphone; and a second feedback removal unit having a fixed filter configured to input the third signal and use a fixed filter coefficient based on a second transfer function of a vibration feedback path from the receiver to the microphone. The first feedback removal unit and the second feedback removal unit are connected in parallel to each other. The second signal is generated by removing from the first signal an output signal from the first feedback removal unit and an output signal from the second feedback removal unit.

In the second hearing aid according to the first hearing aid, the second feedback removal unit includes a first subtraction unit configured to subtract an output signal from the fixed filter, from the first signal, and output a fourth signal, and the first feedback removal unit includes a second subtraction unit configured to subtract an output signal from the adaptive filter, from the fourth signal, and outputs the second signal.

In the third hearing aid according to any one of the first and second hearing aids, the third hearing aid is switchable between a first operation mode in which to operate both of the first and second feedback removal units and a second operation mode in which to operate only the second feedback removal unit.

The fourth hearing aid includes: a microphone configured to convert sound into an electric signal and output a first signal; a hearing aid processing unit configured to perform predetermined hearing aid processing on a second signal generated based on the first signal to generate a third signal; a receiver configured to convert the third signal into sound; a telephone coil configured to convert a magnetic signal into an electric signal and output a fifth signal; a first feedback removal unit having an input filter configured to attenuate a predetermined low-frequency band component from the third signal, and an adaptive filter configured to receive an output signal from the input filter and adaptively estimate a first transfer function of a sound feedback path from the receiver to the microphone; a second feedback removal unit having a fixed filter configured to input the third signal and use a fixed filter coefficient based on a second transfer function of a vibration feedback path from the receiver to the microphone; and a third feedback removal unit having a fixed filter configured to input the third signal and use a fixed filter coefficient based on a third transfer function of a magnetic field feedback path from the receiver to the telephone coil. The second signal is generated based on the first signal and the fifth signal. An output signal from the first feedback removal unit, an output signal from the second feedback removal unit, and an output signal from the third feedback removal unit are respectively removed from the second signal.

The fifth hearing aid includes: a microphone configured to convert sound into an electric signal and output a first signal; a feedback removal unit configured to perform predetermined processing on the first signal to generate a second signal; a hearing aid processing unit configured to perform predetermined processing on the second signal to generate a third signal; and a receiver configured to convert the third signal into sound. The feedback removal unit includes: a first feedback removal unit having an input filter configured to attenuate a predetermined low-frequency band component included in the third signal, and an adaptive filter configured to receive an output signal from the input filter and adaptively estimate a first transfer function of a sound feedback path from the receiver to the microphone; and a second feedback removal unit connected in parallel to the first feedback removal unit and having a fixed filter configured to receive the third signal and use a fixed filter coefficient based on a second transfer function of a vibration feedback path from the receiver to the microphone. The feedback removal unit is configured to generate the second signal by removing from the first signal an output signal from the adaptive filter included in the first feedback removal unit, and an output signal from the fixed filter included in the second feedback removal unit.

The feedback canceller according to the embodiment of the present disclosure may be any one of the following first and second feedback cancellers.

The first feedback canceller includes: a first conversion device configured to convert sound into an electric signal and output a first signal; a signal processing unit configured to perform predetermined hearing aid processing on a second signal generated based on the first signal to generate a third signal; a second conversion device configured to convert the third signal into sound; a first feedback removal unit having an input filter configured to attenuate a predetermined low-frequency band component from the third signal, and an adaptive filter configured to input an output signal from the input filter and adaptively estimate a first transfer function of a sound feedback path from the receiver to the microphone; and a second feedback removal unit having a fixed filter configured to input the third signal and use a fixed filter coefficient based on a second transfer function of a vibration feedback path from the receiver to the microphone. The first feedback removal unit and the second feedback removal unit are connected in parallel to each other. The second signal is generated by removing from the first signal an output signal from the first feedback removal unit, and an output signal from the second feedback removal unit.

In the feedback canceller according to the first feedback canceller, the second feedback removal unit includes a first subtraction unit configured to subtract an output signal from the fixed filter, from the first signal to output a fourth signal. The first feedback removal unit includes a second subtraction unit configured to subtract an output signal from the adaptive filter, from the fourth signal to output the second signal.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A hearing aid comprising:

a microphone configured to convert sound into an electric signal and output a first signal;

a hearing aid processing unit configured to perform predetermined hearing aid processing on a second signal generated based on the first signal to generate a third signal;

a receiver configured to convert the third signal into sound;

a first feedback removal unit having an input filter configured to attenuate a predetermined low-frequency band component included in the third signal, and an adaptive filter configured to receive an output signal from the input filter and adaptively estimate a first transfer function of a sound feedback path from the receiver to the microphone; and a second feedback removal unit having a fixed filter configured to receive the third signal and use a fixed filter coefficient based on a second transfer function of a vibration feedback path from the receiver to the microphone, wherein the first feedback removal unit and the second feedback removal unit are connected in parallel to each other, and the second signal is generated by removing from the first signal an output signal from the adaptive filter included in the first feedback removal unit and an output signal from the fixed filter included in the second feedback removal unit.

2. The hearing aid according to claim 1, wherein the second feedback removal unit includes a first subtraction unit configured to subtract from the first signal an output signal from the fixed filter and output a fourth signal, and the first feedback removal unit includes a second subtraction unit configured to subtract from the fourth signal an output signal from the adaptive filter and output the second signal.

3. The hearing aid according to claim 1, wherein the hearing aid is switchable between a first operation mode in which to operate both of the first and second feedback removal units and a second operation mode in which to operate only the second feedback removal unit.

4. The hearing aid according to claim 2, wherein the hearing aid is switchable between a first operation mode in which to operate both of the first and second feedback removal units and a second operation mode in which to operate only the second feedback removal unit.

5. A hearing aid comprising:

a microphone configured to convert sound into an electric signal and output a first signal;

a hearing aid processing unit configured to perform predetermined hearing aid processing on a second signal generated based on the first signal to generate a third signal;

a receiver configured to convert the third signal into sound;

a telephone coil configured to convert a magnetic signal into an electric signal and output a fifth signal;

a first feedback removal unit having an input filter configured to attenuate a predetermined low-frequency band component included in the third signal, and an adaptive filter configured to receive an output signal from the input filter and adaptively estimate a first transfer function of a sound feedback path from the receiver to the microphone;

a second feedback removal unit having a fixed filter configured to receive the third signal and use a fixed filter coefficient based on a second transfer function of a vibration feedback path from the receiver to the microphone; and a third feedback removal unit having a fixed filter configured to receive the third signal and use a fixed filter coefficient based on a third transfer function of a magnetic field feedback path from the receiver to the telephone coil, wherein the second signal is generated by removing an output signal from the first feedback removal unit, an output signal from the second feedback removal unit, and an output signal from the third feedback removal unit, based on the first signal and the fifth signal.

6. A feedback canceller comprising: a first conversion device configured to convert sound into an electric signal and output a first signal; a signal processing unit configured to perform predetermined hearing aid processing on a second signal generated based on the first signal to generate a third signal; a second conversion device configured to convert the third signal into sound; a first feedback removal unit comprising an input filter configured to attenuate a predetermined low-frequency band component included in the third signal, and an adaptive filter configured to receive an output signal from the input filter and adaptively estimate a first transfer function of a sound feedback path from the second conversion device to the first conversion device; and a second feedback removal unit comprising a fixed filter configured to receive the third signal and use a fixed filter coefficient based on a second transfer function of a vibration feedback path from the second conversion device to the first conversion device, wherein the first feedback removal unit and the second feedback removal unit are connected in parallel to each other, and the second signal is generated by removing from the first signal an output signal from the adaptive filter included in the first feedback removal unit and an output signal from the fixed filter included in the second feedback removal unit.

7. The feedback canceller according to claim 6, wherein the second feedback removal unit includes a first subtraction unit configured to subtract from the first signal an output signal from the fixed filter and output a fourth signal, and the first feedback removal unit includes a second subtraction unit configured to subtract from the fourth signal an output signal from the adaptive filter and output the second signal.

* * * * *